United States Patent [19]

Scheinecker et al.

[11] Patent Number: 4,529,031

[45] Date of Patent: Jul. 16, 1985

[54] APPARATUS AND METHOD FOR CONTINUOUS CASTING

[75] Inventors: Alois Scheinecker, Linz; Jiri Stulik, Leonding; Reinhard Hargassner, Linz, all of Austria

[73] Assignee: Voest-Alpine Aktiengesellschaft, Linz, Austria

[21] Appl. No.: 501,447

[22] Filed: Jun. 6, 1983

[30] Foreign Application Priority Data

Jun. 18, 1982 [AT] Austria ..... 2368/82

[51] Int. Cl.[3] ..... B22D 11/04

[52] U.S. Cl. ..... 164/478; 164/416

[58] Field of Search ..... 164/416, 478

[56] References Cited

U.S. PATENT DOCUMENTS 3,343,592 9/1967 Vogel ..... 164/416

3,822,738 7/1974 Rotarides ..... 164/478 X

FOREIGN PATENT DOCUMENTS

B316038 10/1973 Austria .

1288249 10/1969 Fed. Rep. of Germany .

*Primary Examiner*—Nicholas P. Godici

*Assistant Examiner*—G. M. Reid

*Attorney, Agent, or Firm*—Horst M. Kasper

[57] ABSTRACT

A lifting platform is hinged via oscillating cranks forming a four rod linkage mechanism to a spacially fixed support frame at a continuous casting apparatus with a mold having a curved metal bar axis and disposed at the oscillating lifting platform and the lifting platform forms the connecting rod of this four rod linkage mechanism. In order to avoid the generation of cracks in the metal bar at the transition from the oscillating guide track for the metal bar to the spacially fixed guiding of the bar and in order to be able to adapt the oscillating cranks to close quarters, the longitudinal axes of the oscillating cranks intersect at a point while the mold is in middle position, which point is disposed on a straight line connecting the center of curvature of the guide track of the metal bar to the lower end of the oscillating support surface supporting the metal bar. The oscillating cranks are of differing lengths.

19 Claims, 3 Drawing Figures

1
2
3
4
5
6
7
8
9
10
11
12
13
14
15
16
17
18
19
20
21
23
24
25
P
R
α

4
5
6
7
8
9
10
12
13
18
19
20
21
22
23
24
25
α

APPARATUS AND METHOD FOR CONTINUOUS CASTING

BACKGROUND OF THE INVENTION

1. Field of the Invention

The present invention relates to a continuous casting apparatus with a mold disposed at an oscillating lifting platform as well as possibly a support and guiding provision for the metal bar oscillating in conjunction with the lifting platform and following sequentially to the mold, where the lifting platform is hinged to a spacially fixed support frame via oscillating cranks forming a four bar linkage mechanism and where the lifting platform provides the connecting rod of this four bar linkage mechanism.

2. Brief Description of the Background of the Invention Including Prior Art

A continuous casting apparatus of the kind delineated above is known from the German Patent No. De-C-1,288,249. The oscillating cranks of the known four bar linkage mechanism are directed with their longitudinal axes to the center of curvature of the hollow space of the mold when the mold is disposed at a middle position. At such an alignment of the oscillating cranks the ideal path of the oscillating mold would result if the oscillating cranks were provided with a length corresponding to the radius of curvature of the hollow space of the mold. Since it is impossible to meet such a condition with metal casting apparatus for space reasons, the oscillating cranks have to be provided correspondingly shorter, as is the case with the metal casting apparatus known from the No. DE-C-1,228,249. If the length of the oscillating cranks deviates from the length of the radius of curvature, then deviations from the ideal circular path result for the lower edges of the mold or, respectively, at metal bar guide faces possibly also attached at the mold such as guide, rollers upon oscillating the mold. The metal bar provided with a still thin bar skin shell is more or less strongly loaded by these deviations before the entering into the spacially fixed guide track of the metal bar following sequentially to the mold and the danger exists of bursting of the bar or of generation of cracks.

In order to avoid this danger, the intersection point of the oscillating cranks according to Austrian Patent No. AT-B-260,445 has not been positioned at the center of curvature of the hollow space of the mold, but in a horizontal plane, which on the one hand runs through the center of the hollow space of the mold and which on the other hand runs through the center of curvature of the axis of the path of the metal bar. In fact, the center point of the hollow space of the mold is guided with good approximation along the curved axis of the path of the metal bar, which is provided as the arc of a circle, with an apparatus for continuous casting of this kind. However large deviations of the position of the side walls of the mold from the ideal path of the metal bar also occur at the lower edge of the mold. Also in this case the metal bar skin shell experiences a large mechanical load before entering into the spacially fixed path for guiding the metal bar. Further, a continuous casting apparatus of the kind set forth above is known from Austrian Patent No. AT-B-316,038. This known apparatus for continuous casting is provided with oscillating cranks of unequal lengths hinged to the spacially fixed support frame. In case the mold is in a middle position then the oscillating cranks are parallel to each other. A lateral deviation of a side wall of a mold refers to a displacement from the theoretical or ideal position of said wall. Also in case of this construction a large lateral deviation of a side wall of the mold has to be accepted versus the ideal path of the metal bar.

SUMMARY OF THE INVENTION

1. Purposes of the Invention

It is an object of the present invention to provide an apparatus for continuous casting which avoids the disadvantages recited above and where in case of a mold with a curved hollow space of the mold the deviations from the ideal path for the metal bar are extremely low at the lower end of the oscillating support face supporting the metal bar. It is desirable if at this location no cracks can occur in the strand, and the danger of bursting of the metal bar are decreased.

In addition, it is an object of the invention to provide an apparatus for continuous casting where the engineer of the apparatus is provided with considerable leeway in the disposition of the oscillating cranks. It is desirable if he can take into consideration in various ways the limited space situation below the teeming platform without having consequences arise regarding the accuracy of the guiding of the mold.

It is a further object of the present invention to provide a method where a metal bar is continuously cast. It is desirable if the motion of the mold closely approximates the circular path of the metal bar.

These and other objects and advantages of the present invention will become evident from the description which follows.

2. Brief Description of the Invention

The present invention provides anapparatus for continuous casting of metal bars which comprises an open-ended mold having an inlet and an outlet end and provided with a curved metal bar path axis and attached to an oscillating lifting platform, support and guide provision for the metal bar oscillating in conjunction with the oscillating platform and following to the outlet end of the mold and providing a curved support surface for the metal bar. A four bar linkage mechanism comprises a first oscillating crank and a second oscillating crank both connected to the lifting platform with the lifting platform providing the connecting rod of the four bar linkage mechanism and each crank connected by hinge to the support frame.

The radius of curvature is a radial line extending from the center of curvature. The radius of curvature corresponding to the lowest point of the support surface for the metal bar, the longitudinal axis line of the first oscillating crank and the longitudinal axis line of the second oscillating crank intersect at a first point while the mold is at about a middle position. The connecting line between the lowest point of the support surface for the metal bar and the moving hinge of the first oscillating crank intersects the radius of curvature of the support surface passing through the fixed hinge of the first oscillating crank at a second point and the connection line between the first point and the second point and the radius of curvature at the lowest point of the support surface for the metal bar forms a certain angle at the first point. The line going through the first point and disposed at the certain angle relative to the longitudinal axis line of the second oscillating crank intersects the connecting rod near the moving hinge of the first oscillating crank and the moving hinge of the second oscillating crank at a third point. The line connecting the fixed hinge of the first oscillating crank and the third point intersects the fixed hinge of the second oscillating crank.

The first and second oscillating cranks starting from their hinge points at the lifting platform can be directed toward the side of the locus of the centers of curvature of the curved support surface for the metal bar. The first and the second oscillating cranks can be disposed above the straight line running through the center of curvature and through the lower end of the oscillating support surface for the metal bar.

The first oscillating crank can be directed toward the locus of the centers of curvature from the hinge point at the lifting platform and the second oscillating crank can be directed oppositely away from the locus of the centers of curvature to the outside from the hinge point at the lifting platform. The second oscillating crank can be directed toward the locus of the centers of curvature from the hinge point at the lifting platform and the first oscillating crank can be directed oppositely away from the locus of the centers of curvature to the outside from the hinge point at the lifting platform. One of the two oscillating cranks can be directed toward the locus of the centers of curvature of the curved support surface and this crank can be disposed below the straight line connecting the center of curvature with the lowest point to the supporting surface. The first and the second oscillating cranks can be of different length.

There is also provided a method for continuous casting of metal bars which comprises providing an open-ended mold having an inlet and an outlet end and provided with a curved metal bar path axis and attached to an oscillating lifting platform, extruding molten metal is extruded into the mold. The metal bar is supported and guided with a support and guide provision oscillating in conjunction with the oscillating platform and following to the open end of the mold and providing a curved support surface for the metal bar. The motion of the platform is constrained with a four bar linkage mechanism comprising a first oscillating crank and a second oscillating crank both connected to the lifting platform with the lifting platform providing the connecting rod of the four bar linkage mechanism and each crank connected by hinge to the support frame. The radius of curvature is a radial line extending from the center of curvature. The radius of curvature corresponding to the lowest point of the support surface for the metal bar, the longitudinal axis line of the first oscillating crank and the longitudinal axis of the second oscillating crank intersect at a first point while the mold is at about a middle position of its total permissable path. The connecting line between the lowest point of the support surface for the metal bar and the moving hinge of the first oscillating crank intersects the radius of curvature of the support surface passing through the fixed hinge of the first oscillating crank at a second point and the connection line between the first point and the second point and the radius of curvature at the lowest point of the support surface for the metal bar forms a certain angle at the first point. The line going through the first point and disposed at the certain angle relative to the longitudinal axis line of the second oscillating crank intersects the connecting rod near the moving hinge of the first oscillating crank and the moving hinge of the second oscillating crank at a third point, and where the line connecting the fixed hinge of the first oscillating crank and the third point intersects the point of the fixed hinge of the second oscillating crank. The cast metal bar is removed from the guide and support provision.

The first and second oscillating crank starting from their hinge points at the lifting platform can be directed toward the the side of the locus of the centers of curvature of the curved support surface for the metal bar. The first and the second oscillating cranks can be disposed above the straight line running through the center of curvature and through the lower end of the oscillating support surface for the metal bar. The first oscillating crank can be directed toward the locus of the centers of curvature from the hinge point at the lifting platform and the second oscillating crank is directed oppositely away from the locus of the centers of curvature to the outside from the hinge point at the lifting platform. The second oscillating crank can be directed toward the locus of the centers of curvature from the hinge point at the lifting platform and the first oscillating crank can be directed oppositely away from the locus of the centers of curvature to the outside from the hinge point at the lifting platform. One of the two oscillating cranks can be directed toward the locus of the centers of curvature of the curved support surface and this crank can be disposed below the straight line connecting the center of curvature with the lowest point of the supporting surface. The first and the second oscillating cranks can be of different length.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible embodiments of the present invention.

DESCRIPTION OF INVENTION AND PREFERRED EMBODIMENTS

Figure 1:
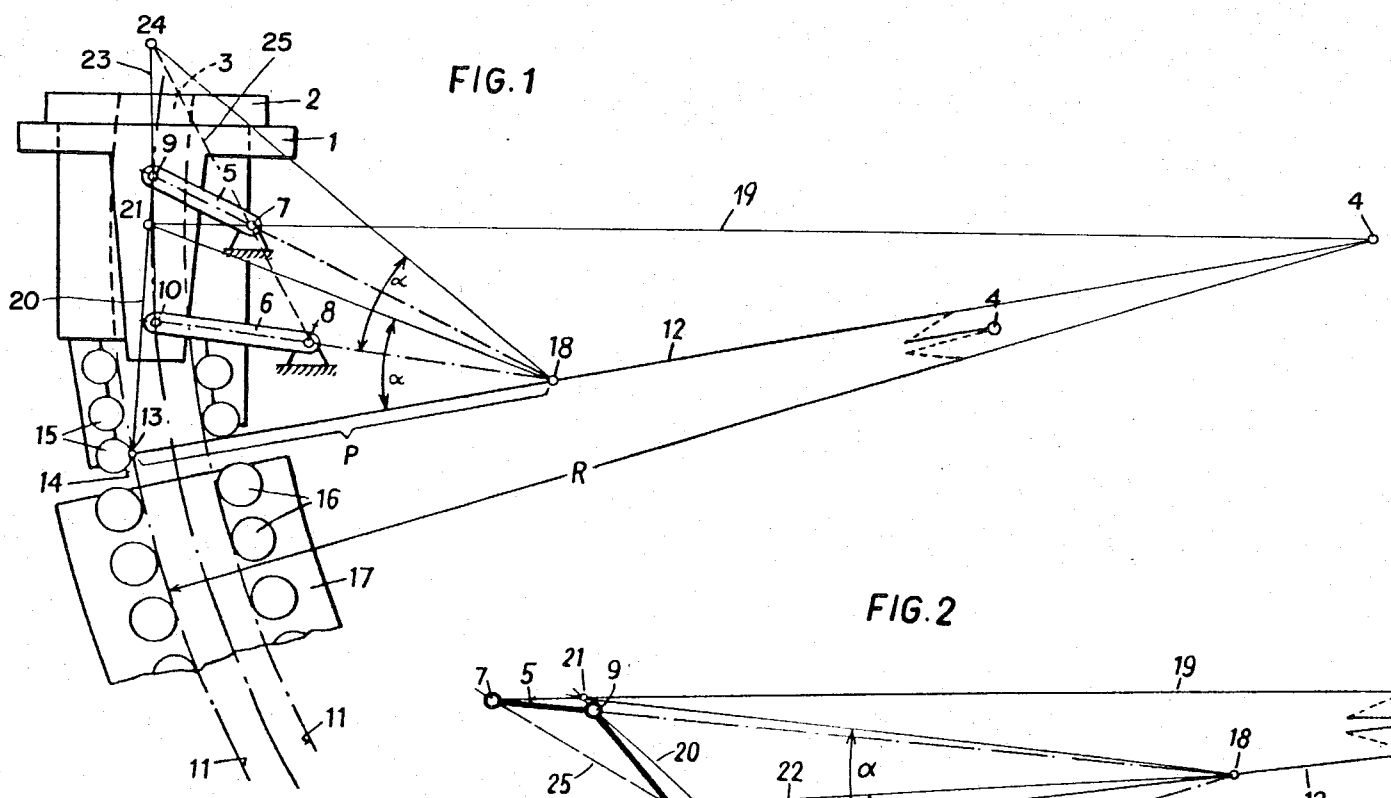
FIG. 1 is a schematic side elevational view of a four rod linkage mechanism supporting the mold of a continuous casting apparatus.

In accordance with the present invention there is provided an apparatus for continuous casting of metal bars comprising an oscillating lifting platform 1, a mold 2 provided with a curved axis for the path of the metal bar, a support and guide provision 15 for the metal bar oscillating together with the lifting platform 1 following to the mold. The lifting platform 1 is hinged via a four bar linkage mechanism formed by oscillating cranks 5, 6 at a spacially fixed support frame. The lifting platform forms the connecting rod of this four bar linkage mechanism.

The longitudinal axes of the oscillating cranks 5, 6 intersect at one point 18 while the mold 2 is at a middle position, which point is located at a straight line 12 connecting the center of curvature 4 of the axis of the path of the metal bar to the lowest end 13 of the support surface 14 supporting the metal bar.

The oscillating cranks 5, 6 are provided with differing lengths, where the length of a second oscillating crank 6 depends upon preset length of the first oscillating crank 5 while the mold 2 is at a middle position is constructed depending on the length of the first oscillating crank 5 as follows: the connection line 19 of the spacially fixed hinge point 7 of the first oscillating hinge 5 to the center of curvature 4 of the guide path 11 for the metal bar and the connection line 20 from the lower end of the oscillating support surface 13 supporting the strand to the moving hinge point 9 of the first oscillating crank 5 intersect (intersection point 21) with each other.

The angle alpha is formed by the intersection of the straight line connecting the intersection point 21 with the intersection point 18 of the extensions of the axes of the oscillating cranks 5, 6 and of the straight line 12 is also drawn again from the longitudinal axis of the second oscillating crank 6 with the apex of the (second) angle alpha situated at the same intersection point 18 remains at the intersection point 18; whereupon the intersection point 24 is determined by the intersection of the transferred angle arm 22 with the axis 23, which is placed through the two hinge points 9, 10 of the lifting platform 1 forming the connecting rod; and whereupon finally a straight line 25 is placed through this intersecting point 24 and the spacially fixed hinge point 7 of the first oscillating crank 5, whicb line 25 intersects with the longitudinal axis of the second oscillating crank 6, which intersection point is the spacially fixed hinge point of the second oscillating crank.

The apparatus for continuous casting can have all oscillating cranks starting from their hinge points 9, 10 at the lifting platform 1 directed toward the the side of the locus of the centers of curvature of the curved support surface for the metal bar. The two oscillating cranks 5, 6 can be disposed above the straight line 12 running through the center of curvature 4 and through the lower end 13 of the oscillating support surface 14 for the metal bar. One (6) of the oscillating cranks 5, 6 can be directed toward the locus of the centers of curvature from the hinge point 10 at the lifting platform 1 and one (5) of the oscillating cranks 5, 6 can be directed oppositely away from the locus of the centers of curvature to the outside from the hinge point 9 at the lifting platform 1. This arrangement is advantageous in case of close quarters below the teeming platform. The oscillating crank 6 directed toward the locus of the centers of curvature of the curved support surface can be disposed below the straight line 12 passing through the center of curvature.

Figure 2:
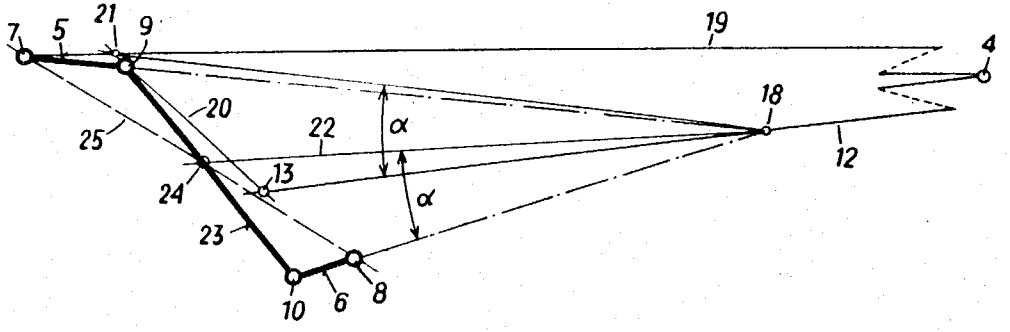
FIG. 2 is another schematic geometrical view of a four rod linkage mechanism supporting the mold of a continuous casting apparatus.

The invention is further illustrated by way of two embodiments shown in the FIGS. 1 and 2 by way of a schematic drawing. A mold lifting platform is designated as 1, at which a mold is attached. The mold lifting platform 1 is moved up and down by way of oscillation provisions not shown here in detail. The mold 2 is provided with an annularly curved mold hollow space 3. The curvature center is designated as 4 at the mold disposed in a middle position.

According to the embodiment shown in FIG. 1 the mold platform is hinged via two oscillating cranks 5, 6, where the spacially fixed hinges of the oscillating cranks are designated as 7, 8 and where the hinges of the oscillating cranks at the mold lifting platform are designated as 9, 10. The two oscillating cranks 5, 6 are directed toward the side of the centers of curvature of the path track 11 for the metal bar.

As can be recognized from FIG. 1, the lengths of the oscillating cranks are substantially shorter than the radius R of the middle line of the guide tracks 11 of the metal bar. In addition, the lengths of the two cranks are different. In the case of the mold being at a middle position, then the dash-dotted lines of the longitudinal axes of the oscillating cranks 5, 6 are intersecting at an imagined line 12, which on the one hand pass through the center or curvature 4 and on the other hand through the lower end 13 of the support face 14 supporting the metal bar and oscillating jointly with the mold. This lower end is formed by the jacket line of a guide roller 15 of the mold 2 contacting the metal bar according to FIG. 1. The lower end of the oscillating support face supporting the metal bar is formed by the lower side of the mold hollow space in case no guide rollers are present. The two oscillating cranks 5, 6 are disposed above the straight line 12 passing through the center of curvature 4 and through the lower end 13 of the oscillating support face 13 supporting the metal bar.

A spacially fixed guide track 17 for the metal bar having attached support rollers 16 follows sequentially to the mold and the support rollers 16 are disposed along a circular arc shaped guide track 11 for the metal bar.

The oscillating cranks 5, 6 are also of unequal length according to the embodiment of FIG. 2 and the extensions of their longitudinal axes intersect at a point 18, which is disposed at the straight line 12, which runs on the one hand through the center of curvature 4 and on the other hand through the lower end 13 of the oscillating support surface supporting the metal bar. One of the oscillating cranks and in fact the lower oscillating crank 6 is directed toward the center of curvature and the first oscillating crank 5 is directed oppositely toward the outside. The embodiment is of particular importance in case of continuous casting apparatus with very close quarters under the teeming platform.

The following steps are performed in the construction of the four rod linkage mechanism of the present invention:

Initially the position of the lifting platform 1 is fixed while the mold 2 is at a middle position as well as the lower end 13 of the support surface 14 oscillating with the mold and supporting the metal bar. Then the lower end 13 of the oscillating support surface 14 supporting the metal bar is connected with a straight line 12 to the center of curvature 4 of the hollow space 3 of the mold or, respectively, of the guide tracks 11 of the metal bar and on this straight line a point 18 is selected, which represents the intersection point of the longitudinal axes of the oscillating cranks 5, 6. The intersection point 18 is connected to the selected hinge points 9, 10 for the oscillating cranks at the lifting platform, whereby the position of the oscillating cranks 5, 6 is fixed while the mold is at a middle position.

The length of a second oscillating crank 6 shall be selected such that, depending on the preset length of the first oscillating crank 5, the deviation of the lower end 13 of the oscillating support surface supporting the metal bar is as far below the ideal guide track 11 of the metal bar as possible. In order to achieve this purpose one proceeds according to the following instructions illustrated in FIG. 2.

After selection of a spacially fixed hinge point 7 of the first oscillating crank 5, the connection line 19 of the spacially fixed hinge point 7 of the first oscillating crank with the center of curvature 4 of the guide track 11 of the metal bar initially intersects the connecting line 20 of the lower end 13 of the oscillating support surface 14 supporting the metal bar and of the moving hinge point 9 of the first hinge 5. The intersection point is designated as 21. Then the angle alpha, which is enclosed by the straight line connecting the intersection point 21 to the intersection point 18 of the extensions of the longitudinal axes of the oscillating cranks 5, 6 and by the straight line 12, drawn from the longitudinal axis of the second oscillating crank 6, where the apex of the angle alpha disposed at the intersection point 18 remains at the intersection point 18. Then the intersection point of the transferred angle arm 22 and of the axis 23, which is defined by the two hinge points 9, 10 of the lifting table 1 providing the connecting rod, is determined (intersection point 24). Finally, a straight line 25 is placed through this intersection point 24 and the locally fixed hinge point 7 of the first oscillating crank 5, which straight line 25 intersects with the longitudinal axis of the second oscillating crank 6, which intersection point is the optimum locally fixed hinge point 8 of the second oscillating crank 6.

Figure 3:
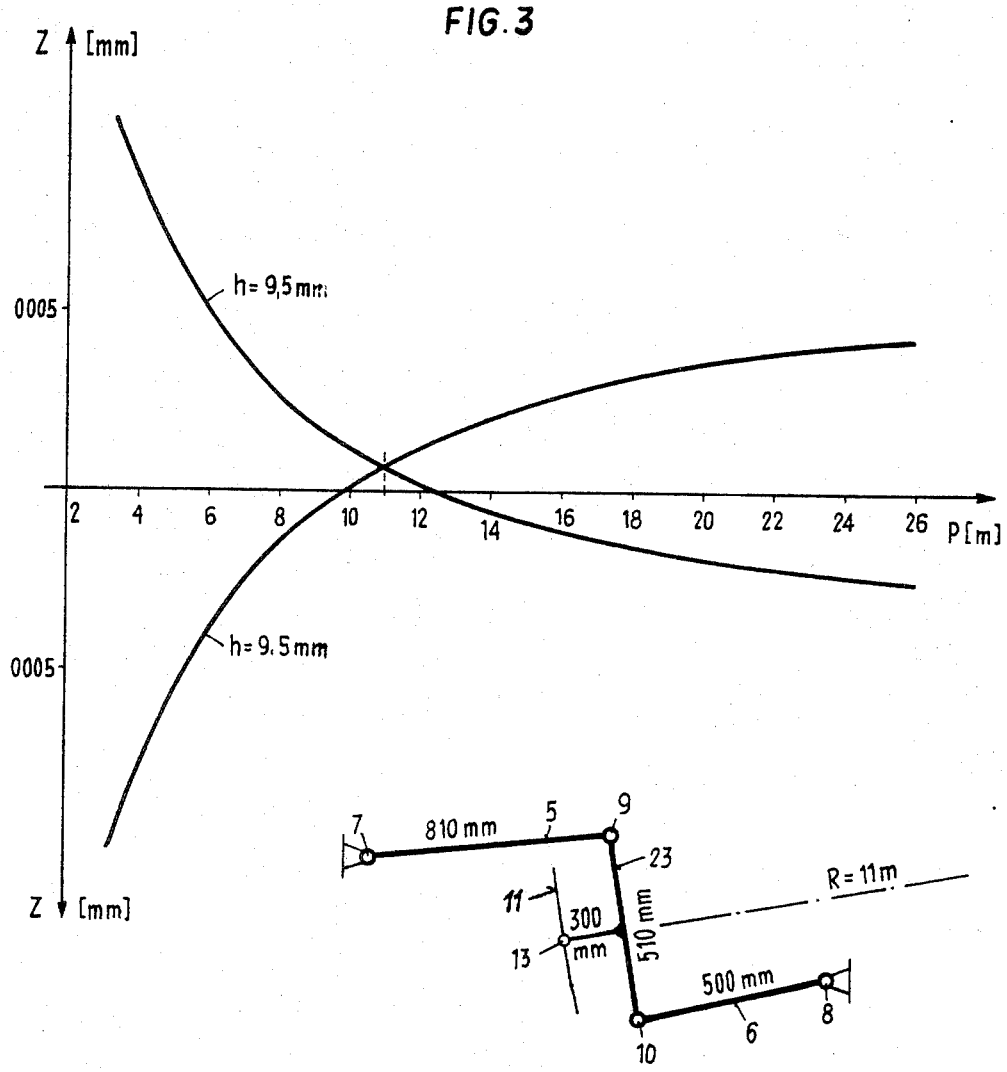
FIG. 3 is a view of a plot illustrating the deviations of the mold from the ideal circular path track for a certain lift depending on different pole distances.

The deviation Z of the lower end 13 of the oscillating support surface supporting the metal bar from a circular arc guide track 11 for the metal bar is illustrated in more detail in FIG. 3 by way of a schematic diagram and depending on a variable pole distance P, which is the distance running from the lower end 13 of the oscillating support face supporting the metal bar to the intersection point 18 of the longitudinal axes of the oscillating cranks 5, 6. The radius of curvature is preset at 11 meters. The first oscillating crank is 810 millimeters long and the connecting rod is 510 millimeters long. It can be recognized from FIG. 3 that for a stroke h of 9.5 millimeters a negligibly small deviation, of a magnitude of a thousandths of a millimeter, of the end 13 is present. An accuracy of this order of magnitude has so far not been possible to achieve for arched molds.

It will be understood that each of the elements described above, or two or more together, may also find a useful application in other types of continuous casting system configurations, melt freezing and metal processing procedures differing from the types described above.

While the invention has been illustrated and described as embodied in the context of an apparatus for continuous casting of metal bars, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. Apparatus for continuous casting of metal bars comprising, in combination, an oscillating lifting platform;

a support frame;

an open-ended mold having an inlet and an outlet end and provided with a curved metal bar path axis and attached to the oscillating lifting platform;

support and guide means for the metal bar oscillating in conjunction with the oscillating platform and following to the open end of the mold and providing a curved support surface for the metal bar;

a four bar linkage mechanism comprising a first oscillating crank and a second oscillating crank both connected to the lifting platform with the lifting platform providing the connecting rod of the four bar linkage mechanism and each crank connected by a fixed hinge to the support frame where a radius of curvature at the lowest point of the support surface for the metal bar, the longitudinal axis line of the first oscillating crank and the longitudinal axis of the second oscillating crank intersect at a first point while the mold is at about a middle position of the positions available to the mold;

where a connecting line between the lowest point of the support surface for the metal bar and a moving hinge of the first oscillating crank intersects a radius of curvature of the support surface passing through the fixed hinge of the first oscillating crank at a second point and a connection line between the first point and the second point and the radius of curvature of the support surface for the metal bar forms a certain angle at the first point;

where a line going through the first point and disposed at the certain angle relative to the longitudinal axis line of a second oscillating crank intersects the connecting rod near the moving hinge of the first oscillating crank and the moving hinge of the second oscillating crank at a third point; and where a line connecting the fixed hinge of the first oscillating crank and the third point intersects the fixed hinge of the second oscillating crank.

2. The apparatus for continuous casting according to claim 1 wherein the first and second oscillating crank starting from their hinge points at the lifting platform are directed toward the the side of the locus of the centers of curvature of the curved support surface for the metal bar.

3. The apparatus for continuous casting according to claim 2 wherein the first and the second oscillating cranks are disposed above the straight line running through the center of curvature and through the lower end of the oscillating support surface for the metal bar.

4. The apparatus for continuous casting according to claim 1 wherein the first oscillating crank is directed toward the locus of the centers of curvature from the hinge point at the lifting platform and the second oscillating crank is directed oppositely away from the locus of the centers of curvature to the outside from the hinge point at the lifting platform.

5. The apparatus for continuous casting according to claim 1 wherein the second oscillating crank is directed toward the locus of the centers of curvature from the hinge point at the lifting platform and the first oscillating crank is directed oppositely away from the locus of the centers of curvature to the outside from the hinge point at the lifting platform.

6. The apparatus for continuous casting according to claim 1 wherein one of the two oscillating cranks is directed toward the locus of the centers of curvature of the curved support surface and this crank is disposed below the straight line connecting the center of curvature with the lowest point ot the supporting surface.

7. The apparatus for continuous casting according to claim 1 wherein the first and the second oscillating cranks are of different length.

8. An apparatus for continuous casting of metal bars comprising an oscillating lifting platform (1), a mold (2) provided with a curved axis for the path of the metal bar, a support and guide means (15) for the metal bar oscillating together with the lifting platform (1) following the mold, where the lifting platform (1) is hinged via a four bar linkage mechanism formed by oscillating cranks (5, 6) each having two hinges at a spacially fixed support frame and where the lifting platform forms the connecting rod of this four bar linkage mechanism, wherein the longitudinal axes of the oscillating cranks (5, 6) intersect at one point (18) while the mold (2) is at a middle position, which point is located at a straight line (12) connecting the center of curvature (4) of the axis of the path of the metal bar to the lowest end (13) of the support surface (14) supporting the metal bar;

the oscillating cranks (5,6) are provided with differing lengths, where the length of a second oscillating crank (6) depends upon preset length of the first oscillating crank (5), while the mold (2) is at a middle position, is constructed depending on the length of the first oscillating crank (5) as follows:

a connection line (19) of the spacially fixed hinge point (7) of the first oscillating hinge (5) to the center of curvature (4) of the guide path (11) for the metal bar and a connection line (20) of the lower end of an oscillating support surface (14) supporting the metal bar the moving hinge point (9), of the first oscillating crank (5) are intersected (intersection point 21) with each other;

then an angle alpha provided by the intersection of the straight line connecting the intersection point (21) with the intersection point (18) of the extensions of the axes of the oscillating cranks (5, 6) and of a straight line (12) is drawn from the longitudinal axis of the second oscillating crank (6), where the apex of the angle alpha situated at the intersection point (18) remains at the intersection point (18);

whereupon the intersection point (24) is determined of an angle arm (22) transferred by an angle alpha with the axis (23), which is placed through the two hinge points (9, 10) of the lifting platform (1) forming the connecting rod; and whereupon finally a straight line (25) is placed through this intersecting point (24) and the spacially fixed hinge point (7) of the first oscillating crank (5), which line (25) is intersected with the longitudinal axis of the second oscillating crank (6), which intersection point is the spacially fixed hinge point of the second oscillating crank.

9. The apparatus for continuous casting according to claim 8 wherein all oscillating cranks starting from their hinge points (9, 10) at the lifting platform (1) are directed toward the the side of the locus of the centers of curvature of the curved support surface for the metal bar.

10. The apparatus for continuous casting according to claim 9 wherein the two oscillating cranks (5, 6) are disposed above the straight line (12) running through the center of curvature (4) and through the lower end (13) of the oscillating support surface (14) for the metal bar.

11. The apparatus for continuous casting according to claim 10 wherein one (6) of the oscillating cranks (5, 6) is directed toward the locus of the centers of curvature from the hinge point (10) at the lifting platfrom (1) and one (5) of the oscillating cranks (5, 6) is directed oppositely away from the locus of the centers of curvature to the outside from the hinge point (9) at the lifting platform (1).

12. The apparatus for continuous casting according to claim 11 wherein the oscillating crank (6) directed toward the locus of the centers of curvature of the curved support surface is disposed below the straight line (12) passing through the center of curvature.

13. A method for continuous casting of metal bars comprising providing an open-ended mold having an inlet and an outlet end and provided with a curved metal bar path axis and attached to an oscillating lifting platform; extruding molten metal into the mold;

supporting and guiding the metal bar with a support and guide provision oscillating in conjunction with the oscillating platform and following to the open end of the mold and providing a curved support surface for the metal bar;

constraining the motion of the platform with a four bar linkage mechanism comprising a first oscillating crank and a second oscillating crank both connected to the lifting platform with the lifting platform providing the connecting rod of the four bar linkage mechanism and each crank connected by hinge to the support frame where the radius of curvature at the lowest point of the support surface for the metal bar, the longitudinal axis line of the first oscillating crank and the longitudinal axis line of the second oscillating crank intersect at a first point while the mold is at about a middle position; where the connecting line between the lowest point of the support surface for the metal bar and the moving hinge of the first oscillating crank intersects the radius of curvature of the support surface passing through the fixed hinge of the first oscillating crank at a second point and the connection line between the first point and the second point and the radius of curvature at the lowest point of the support surface for the metal bar forms a certain angle at the first point;

where the line going through the first point and disposed at the certain angle relative to the longitudinal axis line of the second oscillating crank intersects the connecting rod near the moving hinge of the first oscillating crank and the moving hinge of the second oscillating crank at a third point; and wherein the line connecting the fixed hinge of the first oscillating crank and the third point intersects the fixed hinge of the second oscillating crank; and removing the cast metal bar from the guide and support provision.

14. The method for continuous casting according to claim 13 wherein the first and second oscillating crank starting from their hinge points at the lifting platform are directed toward the the side of the locus of the centers of curvature of the curved support surface for the metal bar.

15. The apparatus for continuous casting according to claim 14 wherein the first and the second oscillating cranks are disposed above the straight line running through the center of curvature and through the lower end of the oscillating support surface for the metal bar.

16. The apparatus for continuous casting according to claim 13 wherein the first oscillating crank is directed toward the locus of the centers of curvature from the hinge point at the lifting platform and the second oscillating crank is directed oppositely away from the locus of the centers of curvature to the outside from the hinge point at the lifting platform.

17. The apparatus for continuous casting according to claim 13 wherein the second oscillating crank is directed toward the locus of the centers of curvature from the hinge point at the lifting platform and the first oscillating crank is directed oppositely away from the locus of the centers of curvature to the outside from the hinge point at the lifting platform.

18. The apparatus for continuous casting according to claim 13 wherein one of the two oscillating cranks is directed toward the locus of the centers of curvature of the curved support surface and this crank is disposed below the straight line connecting the center of curvature with the lowest point ot the supporting surface.

19. The apparatus for continuous casting according to claim 13 wherein the first and the second oscillating cranks are of different length.

* * * * *